United States Patent [19]

Tebbe et al.

[11] Patent Number: 5,048,809

[45] Date of Patent: Sep. 17, 1991

[54] APPARATUS AND METHOD FOR SHEET FOLDING AND SEALING

[75] Inventors: Patrick A. Tebbe, Anna; Carl J. Didier, Piqua, both of Ohio

[73] Assignee: Baumfolder Corporation, Sidney, Ohio

[21] Appl. No.: 343,447

[22] Filed: Apr. 26, 1989

[51] Int. Cl.[5] ..... B42C 1/00

[52] U.S. Cl. ..... 270/45; 270/37; 493/420; 118/32; 118/681; 156/364

[58] Field of Search ..... 270/32, 37, 45, 53, 270/420–421; 493/331, 333, 336; 118/32 X, 671, 681 X; 156/364 X, 443, 350, 226, 227

[56] References Cited

U.S. PATENT DOCUMENTS

| | | | |
|---|---|---|---|
| 3,336,726 | 8/1967 | Mayer | 270/45 |
| 3,511,013 | 5/1970 | Pahlitsch | 270/37 |
| 4,104,983 | 8/1978 | Carstedt | 270/53 |
| 4,817,931 | 4/1989 | Vijuk | 270/37 |
| 4,865,578 | 12/1989 | Moll | 118/681 |
| 4,900,391 | 2/1990 | Mandel | 270/45 |
| 4,957,284 | 9/1990 | Brabant | 270/45 |
| 4,966,353 | 10/1990 | Lehmann | 270/45 |

FOREIGN PATENT DOCUMENTS

| | | | |
|---|---|---|---|
| 2456695 | 1/1981 | France | 270/37 |
| 64-2974 | 1/1989 | Japan | 270/45 |

*Primary Examiner*—Edward K. Look
*Assistant Examiner*—Therese M. Newholm
*Attorney, Agent, or Firm*—Griffin Branigan & Butler

[57] ABSTRACT

An apparatus and method for sheet folding and sealing to produce mailable letter-like objects, each from a single preprinted sheet, comprises a feed mechanism for the feed of sheets in seriatim while continuous beads of adhesive are applied to each sheet along lateral portions thereof. The sheets are fed into a buckle folder which makes one or more transverse folds in each sheet while transversely-spaced spots of adhesive are applied along a transverse line across the sheet. The buckle folder is structured so that it has fold pans on one side; and, both the input and output are on the other side. The folder also includes folding and sealing rolls that seal folded-over sheet portions to close and seal the sheet into a letter-like object. A perforator perforates the object so that tearing along the perforations facilitates opening.

6 Claims, 7 Drawing Sheets

APPARATUS AND METHOD FOR SHEET FOLDING AND SEALING

The present invention relates to apparatus and a method for buckle folding and sealing single sheets, and more particularly to sheet folding, sealing, and providing perforations in the resulting folded and sealed mailable objects to facilitate opening thereof by a recipient. In this manner preprinted sheets of paper are formed into closed and sealed letter-like objects ready for mailing, having preprinted communication information folded within the structure and preprinted address and other customary information in appropriate locations visible on the closed letter-like object.

Devices for folding and sealing sheets are generally known in the prior art. For instance, U.S. Pat. No. 4,701,233 to Beck et al discloses a method for folding and sealing sheets. Beck feeds a sheet along a path for folding and sealing it and, while so feeding the sheet, buckles a portion of of the sheet out of the sheet's normal plane; folds the buckled portion of the sheet; passes the formed fold forward; and, adheres a portion of the sheet to a portion trailing the fold.

Another device for the folding, applying adhesive and perforating of sheets is disclosed in U.S. Pat. No. 3,511,013 to Pahlitzsch.

Other mechanisms and methods for the folding and sealing of insert-containing envelopes are shown in U.S. Pat. Nos. 4,071,997; 4,179,111; 4,312,169; and 4,343,129.

The continuous growth of the volume of business mail and the increasingly high cost of preparation and handling of such mail prior to actual mailing necessitates avoidance of manual preparation and handling procedures. Automation of such processes is required not only in businesses dealing with extremely high volumes, but also in lower mail-volume businesses that have hitherto been unable to justify the customarily high capital investment for conventional automated equipment.

Automation in the preparation of mail for such purposes has been progressing to some extent toward a simplification of the actual letter-like object and away from the traditional prefabricated envelope that is stuffed with inserts. Envelope-like objects are being fabricated, sometimes together with corresponding insert material, by automatic procedures from blank sheet material all the way to objects that are ready for mailing. Such procedures may include preprinting of the sheet material (often also in individualized or personalized manner), folding, bonding, sealing, and perforating for sheet separation and ease of opening by recipients.

Whereas high speed machines have reached the market in recent years, many if not all of the above-noted functions are combined in one large, complex piece of equipment having relatively high cost. Hence, such machines are only for the highest mail-volume users. A large application area for automated mail preparation, however, requires mailings that comprise only single-page communications in volumes that do not justify the acquisition of such complex equipment. Additionally, the complex machines have serious problems with reliability, servicing, maintenance, and the like—particularly where high-speed adhesive applicators are employed. The present invention, therefore, concerns itself with a small, compact folder-gluer for the relatively simple preparation of single-page mailable objects.

Prior art equipment for the folding and sealing of single preprinted sheets into mailable letter-like objects includes a system marketed by GBR Ltd., Chester, Conn. That system is described as a 'One-Step Mailer Cut-Sheet System 401', that converts personalized cut-sheet computer printouts into self-mailers. The GBR equipment converts a flat sheet into a folded self-mailer and glues the lateral sides closed. The transverse flap end is also glued closed. Additionally, the self-mailer is moved through perforation knives to facilitate tear-off opening. The GBR equipment relies upon an offset-type transfer of glue (that is initially applied to a roll) onto the sheet. The glue application system is pressurized and of a recirculating kind, having fixedly disposed applicator nozzles to which glue is metered by solenoid valves. Nozzle tips are fixedly disposed in the immediate proximity of the roll and the sheet. Drops of glue, suspended from nozzle tips, are essentially wiped onto the roll surface and transferred (offset) onto the sheet to provide sealing for the lateral sides of the self-mailer. Drops of glue, suspended from the nozzle tips, are similarly wiped onto the sheet to provide bonding for the transverse flap.

Much of the prior art equipment for single-sheet buckle folding and sealing has relied on adhesive application by means of nozzle and adhesive-feed arrangements that essentially avoid exertion of appreciable retarding forces onto the sheet. Buckle folding and its accuracy, however, are disrupted by the application of such forces to the sheets during the folding process. Thus, much of the above-discussed prior art equipment has relied on application of adhesives by offset-type transfer and by wipe-on or similar dispensing action whereby sheet surfaces are wiped along drops of adhesive suspended from adhesive metering nozzles in order to avoid direct contact of nozzle tips with the sheet surface.

Such procedures involve careful metering of adhesive to the nozzles; and, both the applied adhesive and the suspended drops are exposed to air. Hence, the adhesive tends to prematurely dry and harden. Moreover, such arrangements are liable to drip and ingest air into the nozzles, to result in unreliable operation and failures. Thickening and hardening of adhesive in conduits and between valving and nozzle tips, are also frequent hazards, especially during even short periods of machine inoperation. It will be appreciated, therefore, that frequent cleaning and purging of nozzles, conduits, and valving, are required; and, that meticulous alignment and adjustment of all components and of the adhesive-flow parameters are an imperative requirement for satisfactory operation in such arrangements. Moreover, these costly procedures are absolutely essential subsequent to interruptions of operation.

Concerning avoidance of appreciable retarding forces on sheets while they are traveling through a buckle folder, it will be understood that retarding forces applied in a buckling region or in a free leading region (as a sheet is fed by being pushed) will tend to undesirably wrinkle the sheet. Consequently, complex and costly special feed or nip rolls and the like have been required to accomodate adhesive applicators that exert appreciable retarding forces on the sheets. It has not previously been recognized, however, that certain unique sheet-folding sequences in association with particular layouts of folding components can provide regions on the handled sheets where adhesive applicator forces can be accommodated without causing undesirable wrinkling. Consequently, with those unique arrangements adhesive-applicator nozzles can contact the sheet surfaces without requiring the hereinabove-indicated increases of complexity.

In addition to the problems of nozzle and conduit clogging, and the dripping or insufficiency of adhesive, certain prior art devices also cause undesirable streaking or smearing and trailing of glue upon rolls and along sheet surfaces. Such difficulties occur frequently unless nozzles are kept meticulously aligned and cleaned by frequent servicing which may involve interruption of operation. Particularly concerning glue application to a flap, the drops of glue suspended from the nozzle tips are essentially wiped by the leading edge of the sheet passing thereunder. This has resulted in smearing and streaking of glue past the folded sheet edge and has caused mutual sticking of self-mailers during stacking and subsequent handling. Such malfunctions, therefore, are likely to cause loss of preprinted material and require costly down time and replacement.

Offset-type glue can also cause glue residues upon rolls and undesireable glue transfer to sheets and machine components. One of the objects of the instant invention, therefore, is the provision of a compact and comparatively low-cost buckle folding and sealing apparatus that produces, in a single uninterrupted machine sequence, mailable closed letter-like objects, each from a sheet of preprinted material fed thereto seriatim.

The folding and sealing apparatus of the invention feeds each sheet to a buckle folding mechanism while continuous beads of adhesive are applied by sheet-contacting nozzles directly to the sheet in a precisely controllable manner along a line near the lateral edges of the sheet. One or more transverse folds are made to each sheet, while transversely-spaced spots of adhesive are applied along a transverse edge or fold of the sheet. The folded-over sheet portions are then mutually bonded and sealed in the regions of the adhesive to close and seal the folded sheets into letter-like objects. The adhesive applicator system is substantially non-cloggable and avoids the trailing of adhesive upon the sheet. After sealing, the letter-like objects are perforated along lines parallel to and spaced from each lateral edge so that the objects can be easily opened by a recipient by tearing away the adhesive-containing portions at the perforation lines.

The structure about to be described also provides a compact, high-speed folding and sealing apparatus that comprises a minimum of components; whose mechanisms are easily accessible for maintenance and servicing purposes; whose input and output are disposed on the same side of the apparatus; whose adhesive applicator mechanism is reliable and substantially non-cloggable; and, which is readily adjustable to a variety of commonly-utilized sheet sizes.

It is also an object of this invention to provide a buckle folding and sealing apparatus that facilitates seriatim feeding of preprinted sheets in proper registration directly from another device, such as a printer.

SUMMARY

In accordance With principles of the present invention, a sheet folding and sealing apparatus comprises a feed mechanism for seriatim feed of sheets along a feed-and-fold path while continuous beads of adhesive are applied along lateral edges of each sheet by a first adhesive applicator. The sheets are fed to a buckle folding mechanism for folding one or more transverse folds in the sheets while transversely-spaced spots of adhesive are applied by a second adhesive applicator transverse edges or a transverse fold that abuts a fold pan stop. The folding mechanism has both its input and its output on one side of the folder and first and second fold pans located on the opposite side. The folder also includes folding and sealing rolls that mutually bond and seal folded-over portions of the transversely folded sheets to close and seal the sheet into a letter-like object. The letter-like objects are then perforated so that tearing along the perforation lines removes strips of material which include the adhesively-bonded regions to facilitate opening.

It is a feature of the present invention to provide simple, compact, and relatively low-cost apparatus and a method for sheet folding and sealing to produce letter-like objects from single sheets of preprinted material. Moreover, the apparatus is highly reliable, easy to maintain and service, and has applicators that are substantially non-clogging.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
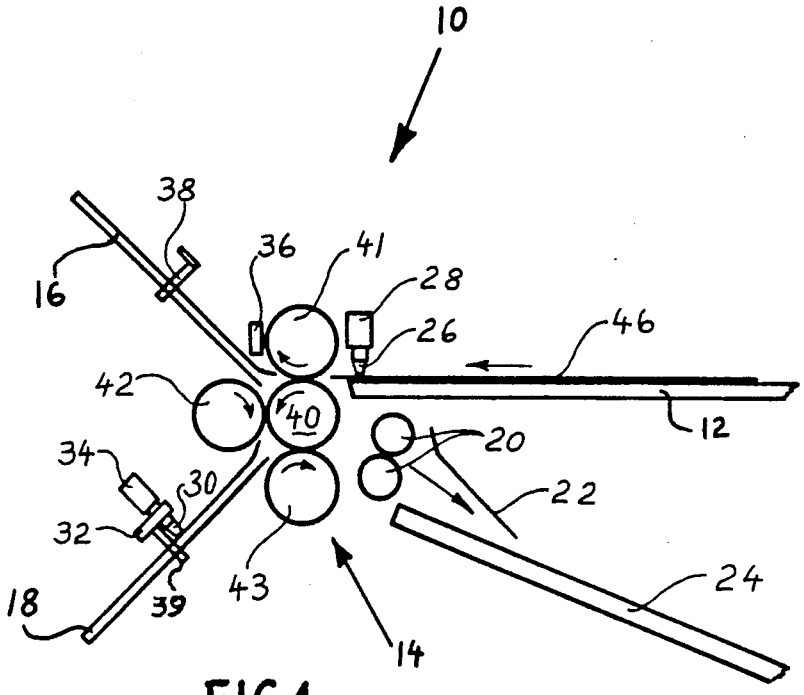
FIG. 1 is a schematic side elevational view of an embodiment of the folding and sealing mechanism of the present invention.

Referring now to the drawings, FIG. 1 shows schematically an embodiment of a C-fold/seal mechanism 10 of an apparatus for sheet folding and sealing in accordance with the present invention. C-fold/seal mechanism 10 comprises a sheet feeder 12 located on the right side of the apparatus; a fold/seal roll arrangement 14; a first fold pan 16 and a second fold pan 18 both located on the opposite side of the apparatus; a perforator roll arrangement 20; and, a deflector 22 and stacker 24 located on the right side for receiving and stacking folded and sealed objects.

C-fold/seal mechanism 10 also comprises a first adhesive applicator that includes two nozzles 26 (only one is shown in FIG. 1), each being advanced and retracted by a solenoid 28, and a second adhesive applicator that includes a plurality of nozzles 30 commonly mounted on a manifold 32 that is advanced and retracted by at least one solenoid 34. The first and second adhesive applicators are included in an adhesive applicator system that further includes photosensor and motion sensor devices (schematically illustrated at 36). The motion sensor is synchronously driven by a roll 41 of fold/seal roll arrangement 14 so that it senses sheet motion therethrough. The first and second adhesive applicators each additionally comprise respective adhesive supply tanks for gravity feed of liquid adhesives through tubing connections therefrom to nozzles 26 and nozzles 30 (via manifold 32), respectively. The adhesive applicator system further comprises signal handling means and controls that actuate solenoids 28 and 34 at appropriate instances in time in dependence upon signals received from the photosensor and motion sensor 36 in accordance with appropriate preselectable manual adjustments to adjust operation to particular sheet and fold sizes.

First fold pan 16 is located on the left side and includes an adjustable abutment stop 38 whose preselected position along first fold pan 16 establishes the distance from the leading edge of a sheet to a first fold therein. Second fold pan 18 is also located on the elft side and includes an adjustable abutment stop 39 whose preselected position along second fold pan 18 establishes the distance from a first fold of a sheet to a second fold therein. In this respect, it should be noted that the placement of both fold pans on the same side of the machine is not customary—particularly where, as noted below, the machine's input and output are both on the side of the machine opposite the fold pans. Adjustable abutment stop 39 additionally includes and carries at least one solenoid 34 in an arrangement for advancing and retracting manifold 32 (and therewith nozzles 30) substantially orthogonally to the plane of second fold pan 18 in response to energization or deenergization of solenoid or solenoids 34.

Fold/seal roll arrangement 14 comprises a main drive roll 40 and a first, a second, and a third roll 41, 42, and 43, respectively. On the side of the machine opposite the fold pans, a sheet 46 is shown being fed by sheet feeder 12 toward the nip between main drive roll 40 and first roll 41. Any one of a variety of conventionally-used sheet feeders may be utilized here as sheet feeder 12. For example, belt or roller conveyors suitable for in seriatim feed of sheets may be utilized, or stack or hopper feeders that serially deliver individual sheets are appropriate. However, a stack feeder that removes individual sheets from the bottom of a stack by means of sucker cups or similar conventional mechanisms and that feeds such sheets serially to fold/seal arrangement 14 is preferred. An alternative sheet feeder is a conventional cross carrier table that is preferred when the apparatus for sheet folding and sealing of this invention is directly automatically serially fed with preprinted sheets delivered from other equipment such as a printing machine.

Stacker 24 is also located on the side opposite the fold pans and is a customary device used for shingling and stacking sheets, folded flat materials, envelopes, and the like. As shown in FIG. 1, stacker 24 receives individual folded and sealed sheets as they are delivered from perforator roll arrangement 20, whereby deflector 22 deflects such folded and sealed sheets onto the surface of stacker 24.

The invention can employ conventional stack feeders or cross carrier tables and buckle folder elements 14, 16, and 18, and devices that transfer the folded and sealed objects for subsequent operations. Such devices are commercially available in folding systems manufactured by the Baumfolder Corporation, Sidney, Ohio, under the name 'Ultrafold 714' and '714 Ultrafold Right Angle'.

Conventional adhesive applicator elements can also be employed. Such elements, for example, can be obtained from Pafra, Inc., Wayne, N.J., 07470, under the name 'Pafra SCU Gluing System'.

Figure 2:
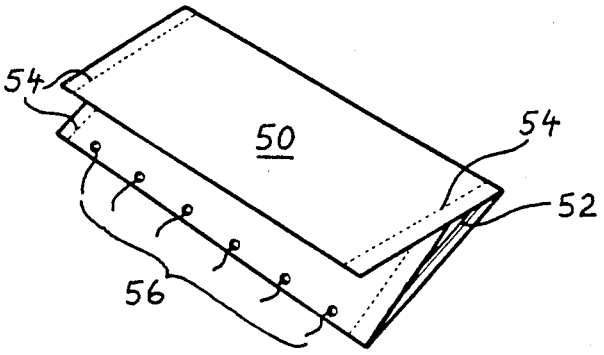
FIG. 2 is a schematic perspective view of a mailable object prepared in the mechanism shown in FIG. 1.
Figure 6:
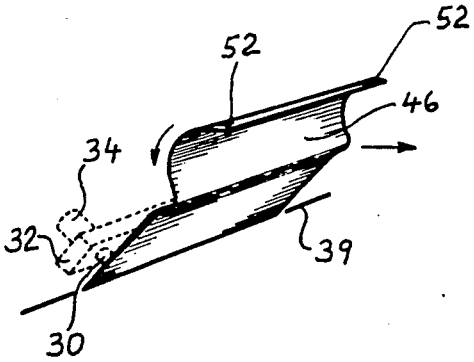
Figure 7:
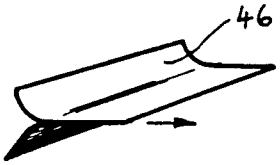
Figure 8:
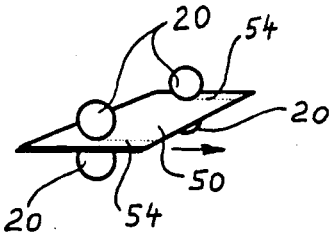

Referring now also to FIG. 2 in conjunction with FIGS. 4 through 8, a mailable object 50 that is produced by the C-fold/seal mechanism 10 of FIG. 1 is depicted in an incompletely closed form in FIG. 2, and in FIG. 8 in its actual closed and sealed state as it is being fed through perforator roll arrangement 20 (and being delivered to stacker 24 of FIG. 1). As can be seen from FIG. 2, mailable object 50 is a twice-folded sheet, having its folds spaced apart and spaced with respect to the leading and trailing edges by about one third of the length of sheet 46. This particular folding is a so-called "C-fold" or "letter fold." FIGS. 3 through 8 represent a sequential series of momentary shapes of deformations that a sheet 46 undergoes in the course of being fed through and being folded and sealed by C-fold/seal mechanism 10.

Figure 3:
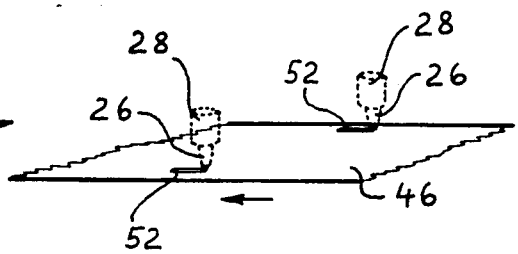

In FIG. 3, sheet 46 is shown as it is being pulled by and through the nip between main drive roll 40 and first roll 41 (from the surface of sheet feeder 12) and as it is being pushed into first fold pan 16. At this time also, nozzles 26 of the first adhesive applicator are in contact with the surface of sheet 46, having been advanced thereto from a retracted position by energized solenoids 28. As a consequence of the contact between the tips of nozzles 26 with sheet 46, continuous beads of adhesive, indicated here as beads 52, are layed down onto the sheet surface, while sheet 46 is being transported into first fold pan 16 and farther within fold/seal roll arrangement 14. Solenoids 28 are energized, and nozzles 26 are advanced into contact with sheet 46 thereby, in a longitudinal location along sheet 46 approximately when one third of the length of sheet 46 has passed under nozzles 26, and solenoids 28 are deenergized, causing retraction of nozzles 26, just before the trailing edge of sheet 46 passes under nozzles 26. Consequently, adhesive beads 52 are not applied to the trailing edge of sheet 46. Beads 52 are applied in the proximity of the lateral edges of sheet 46, but in such locations that the adhesive is spaced from these edges so that it will not be squeezed out in subsequent closing and sealing of the folded sheet.

In regard to the operation of nozzles 26 and 30, which will be described hereinafter in further detail, reference is made here to FIGS. 15 and 16 to indicate the structure of the nozzle tips that provides for their functioning and application of beads 52 to sheet 46 in the manner hereinabove described.

Figure 4:
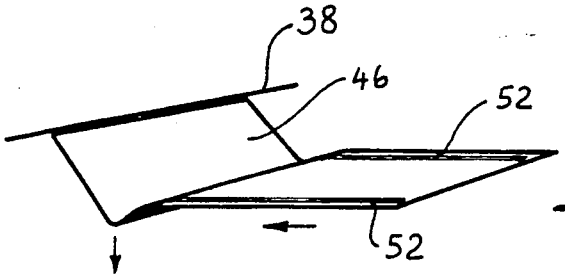
FIGS. 3 through 8 represent a sequential series of schematic perspective views of an example of a sheet being converted into a mailable object in the mechanism shown in FIG. 1.
Figure 5:
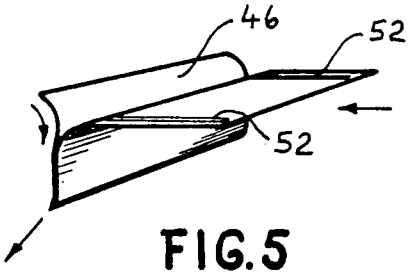

In FIG. 4, sheet 46 is shown just after having its leading edge stopped by abutment stop 38 in first fold pan 16. The continuing feed of sheet 46 by the nip between main drive roll 40 and driven first roll 41 results in downward buckling of the sheet in the region of the desired first fold, namely about one third of the sheet length from the leading edge of the sheet, as indicated. The downward buckle is subsequently squeezed to a fold that is captured in the nip between main drive roll 40 and also-driven second roll 42, as depicted in FIG. 5. This buckling and subsequent folding is a conventional buckle-folding process that is well-known in the art.

In FIG. 5, the now leading edge, being the edge of the first fold, is shown subsequent to having passed second roll 42 and as just entering second fold pan 18. It can be seen that the nip between main drive roll 40 and second roll 42 already squeezes and seals the first fold onto the next one third length of sheet 46, whereby bonding occurs due to the previously applied adhesive.

In FIG. 6, the first fold is shown just after having its edge stopped by abutment stop 39 in second fold pan 18. At about this time, manifold 32 together with nozzles 30 mounted thereupon are momentarily advanced and retracted again by energization and subsequent deenergization, respectively, of solenoid or solenoids 34 to have nozzle tips momentarily contact the first-folded sheet surface along a transverse line in the proximity of the edge of the first fold, and to thusly deposit a plurality of spots of adhesive onto the sheet. The locations of these spots are spaced from the edge of the first fold such that adhesive will not be squeezed out from between the folded and closed sheet during subsequent sealing thereof. The continuing feed of sheet 46 by the nip between main drive roll 40 and second roll 42 results in buckling of the sheet in the region of the desired second fold, namely about one third of the sheet length from the trailing edge of the sheet, as indicated. This buckle, which includes a portion of the first-folded and sealed sheet, is subsequently squeezed to a second fold that is captured in the nip between main drive roll 40 and also-driven third roll 43, as depicted in FIG. 7.

In FIG. 7, the now leading edge, being the edge of the second fold, is shown subsequent to having passed through the nip between main drive roll 40 and third roll 43, whereby the now twice-folded sheet 46 is completely closed and sealed including a bond along the edge of the last-folded over sheet (the flap edge) by the adhesive spots applied as hereinabove indicated in conjunction with in FIG. 6. This twice-folded and sealed sheet 46 is now fed farther toward and through perforator roll arrangement 20, as indicated in FIG. 8.

In FIG. 8, the now twice-folded and sealed sheet is shown being perforated by perforations 54 that are disposed parallel to and spaced from its lateral edges so that tearing along perforations 54 removes strips of material that include the regions of previously applied adhesive beads 52, thusly facilitating opening of the resulting mailable object 50 by a recipient. Mailable object 50 is now fed to stacker 24.

The adhesive applicator system comprises a first and a second adhesive applicator. Different liquid adhesives are generally utilized in the two applicators. The first adhesive applicator, which serves to provide adhesive for bonding of lateral sides of sheets, generally uses an adhesive that has high adhesion properties to permanently bond, whereas the second adhesive applicator, which serves to bond down the flap of a mailable object by a plurality of spaced apart spots, generally delivers an adhesive that facilitates release of the flap without tearing of the sheet material when the flap is manually peeled of pulled off, while keeping the flap securely bonded during normal mail handling operations.

In view of the foregoing description, the depiction of the incompletely closed mailable object 50 in FIG. 2 will be recognized now as an aid to better understanding of the actual form of a propely closed and sealed mailable object 50, as produced by C-fold/seal mechanism 10 of FIG. 1. FIG. 2 also shows the plurality of adhesive spots 56 that are applied by the second adhesive applicator during folding and sealing, as described particularly in conjunction with FIG. 6 and that serve to seal down the trailing (transverse) edge of sheet 46 (the flap).

Prior to operating the C-fold/seal mechanism 10, various adjustments are performed. In particular, the positions of abutment stops 38 and 39 are adjusted along their respective fold pans to accommodate the particular sheet length to be handled so that the folds divide the sheet into three approximately equal lengths or as otherwise preestablished. Further, the adhesive applicator system is preadjusted to energize and deenergize solenoids at the proper times to apply adhesives to sheet 46 in the desired locations thereupon. The latter preadjustment is also performed to accommodate particular sheet lengths to be handled. The adhesive applicator system controls track the advance of a sheet through mechanism 10 by the motion sensor that is synchronously coupled to a roll of fold/seal roll arrangement 14 (FIG. 1). The leading edge of a sheet is sensed by the photosensor to start the tracking procedure, and respective solenoids are energized and deenergized in dependence on the adjustments that are a function of travel distances from the initially-sensed leading edge of a sheet.

Figure 9:
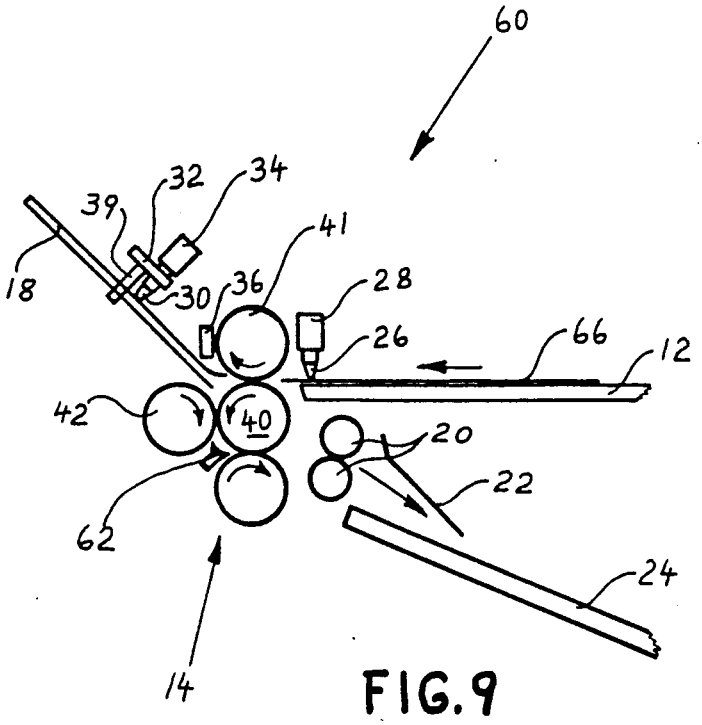
FIG. 9 is a schematic side elevational view of another embodiment of the folding and sealing mechanism of the present invention.

Referring now to FIG. 9, a V-fold/seal mechanism 60 is depicted therein that is in some respects identical to C-fold/seal mechanism 10 of FIG. 1, and that also comprises sheet feeder 12 on a first side of the machine; fold/seal roll arrangement 14; and, perforator roll arrangement 20, deflector 22, and stacker 24 all on the first side. In other words, both the input and the output are on the same side.

V-fold/seal mechanism 60 differs from C-fold/seal mechanism 10 only in that it comprises second fold pan 18 in the location of first fold pan 16 on the second side of the machine (opposite its input and output). First fold pan 16 of FIG. 1 (not shown in FIG. 9) is removed from the feed path of sheet 46, in that a deflector 62 is now disposed in the region where the entry to second fold pan 18 (in FIG. 1) was previously disposed. The leading edge of a fold in sheet 46 is now deflected by deflector 62, as it is being fed thereto between main drive roll 40 and second roll 42, into the nip between main drive roll 40 and third roll 43. Similarly, the V-fold/seal mechanism also comprises the adhesive applicator system including first and second adhesive applicators, photosensor and motion sensor 36, as well as signal handling and controls for actuation of solenoids 28 and 34.

Figure 10:
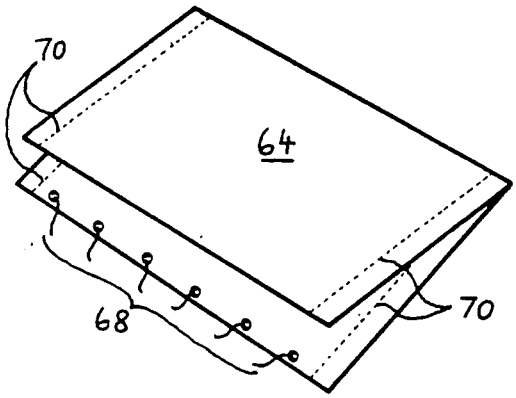
FIG. 10 is a schematic perspective view of a mailable object prepared in the mechanism shown in FIG. 9.

Referring now to FIG. 10, a mailable object 64, that is produced by V-folding (half-folding) of a sheet 66 in V-fold/seal mechanism 60 (shown in FIG. 9), is depicted here in incompletely closed form to facilitate illustration of the invention. Adhesive spots 68 are applied to the inside of sheet 66, and serve to bond the transverse end edges thereof together, while continuous adhesive beads (hidden in FIG. 10) along the lateral edges, have been applied to the inside face of of the upper folded half of mailable object 64 and serve to seal lateral edges thereof together. Also shown here are lines of perforations 70, along which strips of material are torn off during opening by a recipient.

It should be understood that functions of identical components, individually and cooperatively, are analogous between C-fold/seal mechanism 10 of FIG. 1 and V-fold/seal mechanism 60 of FIG. 9.

Figure 12:
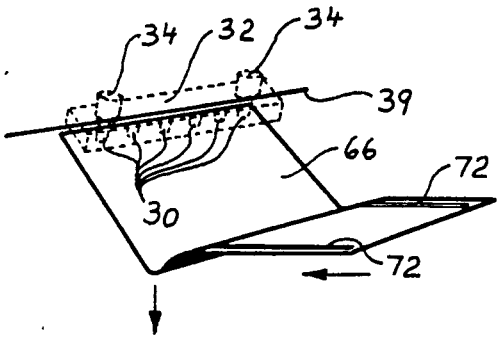
FIGS. 11 through 14 represent a sequential series of schematic perspective views of an example of a sheet being converted into a mailable object in the mechanism shown in FIG. 9.
Figure 13:
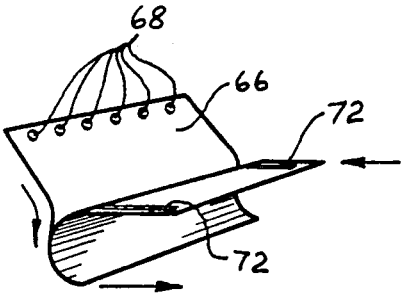
Figure 14:
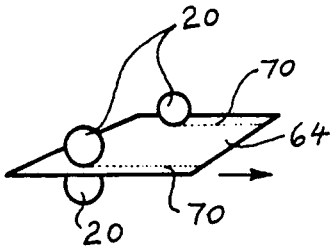

Referring now to FIG. 9 in conjunction with FIGS. 10 and FIGS. 11 through 14, depicted in FIG. 14 is mailable object 64 in its actual closed and sealed state, as it is being fed through perforator roll arrangement 20, wherein it is being provided with perforations 70, and from where it is being delivered to stacker 24. As can be seen from FIG. 10, mailable object 64 is a once-folded sheet, having its fold disposed about in the middle of the sheet length. This fold is called a V-fold or a half-fold. FIGS. 11 through 14 represent a sequential series of momentary shapes of deformations that sheet 66 undergoes in the course of being fed through and being folded and sealed in V-fold/seal mechanism 60.

Figure 11:
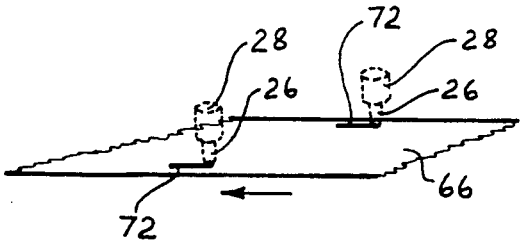

In FIG. 11, sheet 66 is shown as it is being pulled by and through the nip between main drive roll 40 and first roll 41 (from sheet feeder 12) and as it is being pushed into second fold pan 18. At this time also, nozzles 26 of the first adhesive applicator are in contact with the surface of sheet 66, having been advanced thereto from a retracted position by energized solenoids 28. As a consequence of the contact between the tips of nozzles 26 and sheet 66, continuous beads of adhesive, indicated here as beads 72, are layed down onto the sheet, while sheet 66 is being transported into second fold pan 18 and farther within fold/seal roll arrangement 14. Solenoids 28 are energized, and nozzles 26 are advanced into contact with sheet 66 in a longitudinal location along sheet 66 approximately when one half of the length of sheet 66 has passed under nozzles 26. Solenoids 28 are deenergized, causing retraction of nozzles 26, just before the trailing edge of sheet 66 passes under nozzles 26. Consequently, adhesive beads 72 are not applied to the trailing edge of sheet 66. Beads 72 are applied in the proximity of the lateral edges of sheet 66, but in such locations that the adhesive is spaced from these edges so that it will not be squeezed out in subsequent closing and sealing of the folded sheet.

In FIG. 12, sheet 66 is shown just after having its leading edge stopped by abutment stop 39 in the second fold pan 18. The continuing feed of sheet 66 by the nip between main drive roll 40 and also-driven first roll 41 results in downward buckling of the sheet in the region of the desired fold, namely about one half of the sheet length from the leading edge of the sheet, as indicated. The downward buckle is subsequently squeezed to a fold that is captured in the nip between main drive roll 40 and also-driven second roll 42, as depicted in FIG. 13. This buckling and subsequent folding is a conventional buckle-folding process that is well-known in the art. At about the time the leading edge of sheet 66 is stopped by abutment stop 39 in fold pan 18, manifold 32 together with nozzles 30 mounted thereupon are momentarily advanced and retracted again by energization and subsequent deenergization, respectively, of solenoid or solenoids 34 to have nozzle tips momentarily contact the surface of sheet 66 along a transverse line in the proximity of the leading edge of sheet 66 and to thusly deposit a plurality of adhesive spots 68 onto the sheet. The locations of adhesive spots 68 are spaced from the leading edge of sheet 66 such that adhesive will not be squeezed out from between the folded and closed sheet during subsequent sealing thereof.

In FIG. 13, the now leading edge, being the edge of the fold, is shown subsequent to having passed through the nip between main drive roll 40 and second roll 42, whereby the now folded sheet 66 is being completely closed and sealed, and having been deflected by deflector 62 to enter the nip between main drive roll 40 and also-driven third roll 43 for farther feed toward and through perforator roll arrangement 20, as indicated in FIG. 14.

In FIG. 14, the now folded and sealed sheet is shown as it is being perforated by perforations 70 that are disposed parallel to and spaced from its lateral edges so that tearing along perforations 70 removes strips of material that include the regions of previously-applied adhesive beads 72, thusly facilitating opening of the resulting mailable object 64 by a recipient. After perforation, the mailable object 64 is fed to stacker 24, as described in conjunction with FIG. 9.

An adhesive applicator system, as hereinbefore described particularly in conjection with the C-fold/seal mechanism 10 shown in FIG. 1, is similarly also included in V-fold/seal mechanism 60 of FIG. 9 and has substantially the same structure and function. Also the adjustments for the C-fold/seal mechanism 10 are essentially equally applicable to V-fold/seal mechanism 60, except that the position of abutment stop 39 is adjusted along fold pan 18 to accommodate the particular sheet length so that the fold divides the length of sheet 66 into about equal halves.

Figure 15:
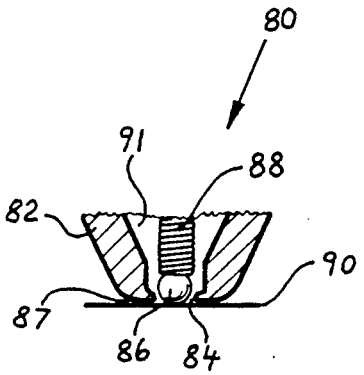
FIGS. 15 and 16 are schematic sectional views through a fragmented portion of the tip of an adhesive-applicator nozzle used by the present invention in open and closed state, respectively.
Figure 16:
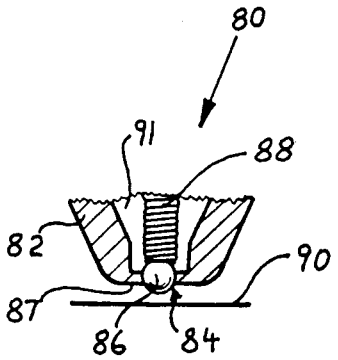

FIGS. 15 and 16 show a fragmented portion of the tip of the adhesive nozzles (such as nozzles 26 and 30) included in the adhesive applicator system of the folding and sealing apparatus of the invention. A nozzle tip 80 includes a tip housing 82 that is a continuation of a nozzle body and that serves as a conduit for the feed of liquid adhesive to an exit opening 84 in tip housing 82. Further comprised in nozzle tip 80 is a ball 86 that has a slightly larger diameter than exit opening 84 and that is capable of hermetically sealing exit opening 84 when it is seated therein from within tip housing 82. When thusly seated, a portion of ball 86 extends outside beyond a face 87 at the end of tip housing 82, as shown in FIG. 16. Additionally, a compression spring 88 extends concentrically between a here not shown spring support disposed within tip housing 82 and ball 86. In this manner, the spring forces ball 86 into exit opening 84 for secure closure and sealing thereof in the absence of any displacement forces acting on ball 86 that would overcome the force of compression spring 88. Also indicated in FIGS. 15 and 16 is a portion of a sheet 90 over which nozzle tip 80 is disposed.

In operation, gravity-fed liquid adhesive is supplied to the nozzles and fills conduits thereto including a region 91 that leads to opening 84 within tip housing 82. When nozzle tip 80 is spaced from the surface of sheet 90 (as indicated in FIG. 16), ball 86 keeps exit opening 84 hermetically closed and thereby prevents liquid adhesive from flowing therethrough (as well as preventing air from entering). When a nozzle is moved or advanced to contact sheet 90 so that ball 86 is depressed and a gap is opened in opening 84 (as indicated in FIG. 15), liquid adhesive flows therethrough substantially over the surface of ball 86 and is applied thereby onto sheet 90. During such time, face 87 is still spaced sufficiently from sheet 90 so that the adhesive does not smear along face 87, but is essentially dispensed onto sheet 90 only over ball 86, for instance in an analogous manner to the way ball-point pens write. Upon retraction of a nozzle (to lift ball 86 off sheet 90), opening 84 is closed again by the force of spring 88 and adhesive flow therethrough stops.

Advance and retraction of nozzles 26 and 30 are accomplished by means of solenoids that are energized and deenergized in proper timing under control of the adhesive applicator system in accordance with appropriate preadjustments in dependence on sheet transport travel to apply adhesive in desired locations upon the sheet.

In view of the above description of the operation of the nozzles, advantages thereof over adhesive applicators conventionally used in sheet folding and sealing will be recognized particularly in that positive shut-off of adhesive is provided at all times when adhesive is not applied to sheet surfaces and positive-contact, ball-point type dispensing is utilized that ensures relatively precise adhesive application rather than a wiping or smearing action as heretofore employed. Advantages of the adhesive nozzles and the adhesive applicator system include especially the avoidance of adhesive dripping and smearing from nozzles, avoidance of adhesive hardening at and in nozzles and conduits leading thereto, and the substantial non-cloggability thereof.

Figure 17:
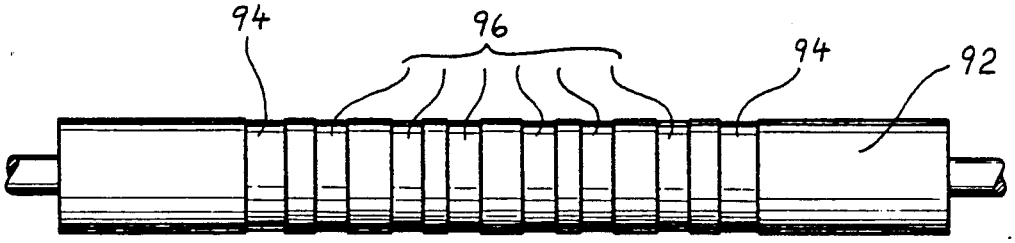
FIG. 17 is a schematic side view of one of the buckle folding and sealing rolls shown in FIGS. 1 and 9.

Fold/seal roll arrangement 14, particularly in conjunction with FIGS. 1 and 9, comprises main drive roll 40 and rolls 41, 42, and 43. In some respects, these rolls are substantially alike and are, in this regard, described in conjunction with FIG. 17, wherein a roll 92 is shown that is representative of some of the relevant similarities between these rolls. As has been customary in conventional folding machines, roll 92 is basically a metal cylinder that is provided with appropriate concentric shaft extensions at both ends and that is variously coated and provided with outer layers of elastomeric materials to provide required properties of resiliency and surface friction for effective folding operations. For instance, feeding of sheets between pairs of such rolls with adequate friction to prevent slippage and offering an adequate degree of resiliency to accommodate one and more sheets and a range of sheet thicknesses and stiffness variations thereof is provided by such outer layers of elastomeric materials that include, for example, rubber compositions, polyurethane materials, and the like.

As illustrated, the rolls are additionally provided with concentric grooves in the otherwise cylindrical surface, indicated here by grooves 94 and 96 in roll 92. Grooves 94 and 96 are provided with one or more coating layers of PTFE (polytetrafluoroethylene) or Teflon material, for instance in the form of Teflon tape having been wound therearound. This is done to provide surface properties that offer very low friction characteristics and, particularly, to prevent adhesion and promote release of adhesive material which these surfaces may contact. In order to further assist this purpose, the thusly coated surfaces of grooves 94 and 96 are of a somewhat smaller diameter than the adjacent cylindrical roll surfaces.

Regions upon rolls which otherwise do or might directly contact adhesive applied to sheets during operation of the apparatus of the invention are provided with grooves whose coated surfaces provide a relatively deep relief with respect to the adjacent cylindrical surface diameter of roll 92, so that the adhesive is, in fact, usually prevented from contacting these coated surfaces during normal operation. Nonetheless, the easy release and cleaning properties of these coated surfaces make allowance for undesirable abnormal situations that may occur particularly during set-up of the machine or during a malfunction thereof, when adhesive may be applied in incorrect locations, in excessive amounts, etc., and may then reach these coated surfaces. The depth of such a relief is, for instance, between 0.054 and 0.114 inches in a preferred embodiment of the apparatus, wherein the greater depths are utilized for grooves 94, which are disposed in regions that might be exposed to adhesive applied, for example, in beads 52 (FIGS. 2 through 7) or in beads 72 (FIGS. 10 through 13), and the lesser depths are utilized, for example, for grooves 96, which are disposed in regions that might be exposed to adhesive applied, for instance, in spots 56 (FIG. 2) or in spots 68 (FIGS. 10 and 13).

Main drive roll 40 and third roll 43 (FIGS. 1 and 9) apply the final sealing pressure to a folded sheet fed therebetween and they are also the rolls whose surfaces are likely to be exposed to adhesive due to malfunctions and particularly only then, for instance, as a consequence of transfer of adhesive between mechanism components and sheet materials. These rolls are also provided with grooves in the same axial locations (being the locations that are most likely to be exposed, if at all, to contamination by adhesive) the coated surfaces of these grooves are of only slightly smaller diameter (for instance only 0.005 inches smaller in diameter) than the adjacent roll diameter in order to provide for proper final closing and sealing pressure for folded sheets handled thereby. It will be understood that any slight relief of the groove surfaces is taken up by the resiliency of the roll surface material during mutual (normally slightly preloaded) contact between rolls and sheet material during operation. The easy-release properties of the coating of the grooves in roll 92 facilitate cleaning thereof; in particular of any adhesive residues that may be deposited thereupon.

Adhesive used in sheet sealing and bonding in a folding mechanism is liable to be transferred to components of the mechanism during its operation, particularly also by transfer from sheet surfaces to which the adhesive has been intentionally applied. Needless to say, such adhesive transfer is undesirable and should to be avoided. Rolls of the fold/seal mechanism are provided with Teflon coated grooves to avoid such undesirable adhesive transfer and to facilitate easy removal and cleaning of any adhesive that might be transferred. Also other component surfaces of the fold/seal mechanism, which may be exposed to contact with adhesive, are provided with a Teflon coating or surface plating that similarly serves to avoid adhesive transfer thereto and that facilitates easy removal and cleaning of any adhesive residues. Such component surfaces include, for instance, surfaces of components of fold pans 16 and 18 (FIGS. 1 and 9) that face inwardly toward handled sheets, particularly in regions that face regions of adhesive applied to the sheet. In this respect, in a preferred embodiment the surfaces of fold pans 16 and 18 are of hard chrome that is impregnated with PTFE.

Figure 18:
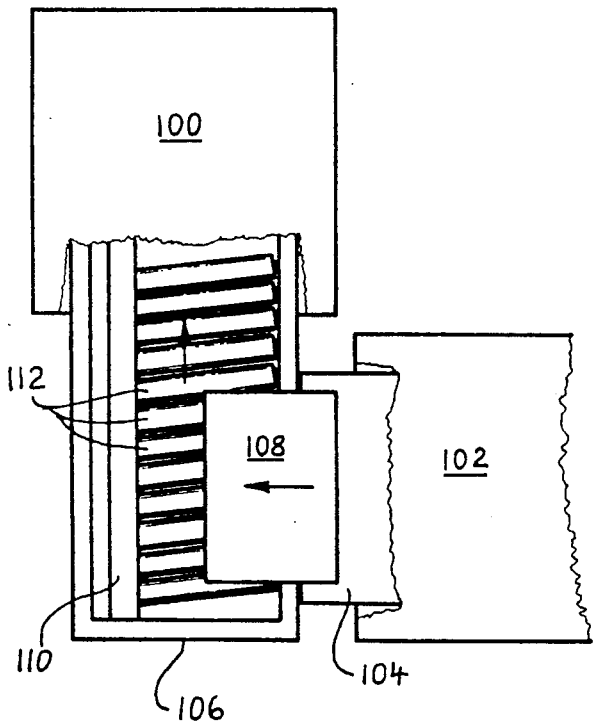
FIG. 18 is a schematic top view of an apparatus in accordance with the invention for sheet folding and sealing that is directly fed preprinted sheets by a another device.

Referring now to FIG. 18, an embodiment of the present invention is schematically depicted here that comprises a sheet folding and sealing apparatus 100 being automatically fed with sheets from another device 102 that is preferably a printer which appropriately preprints the sheets and delivers them in seriatim, via a delivery means 104, to a sheet feeder including a cross carrier 106, whereby sheets are fed into a fold/seal mechanism of sheet folding and sealing apparatus 100 in proper registration. A sheet 108 is shown being delivered by delivery means 104 onto cross carrier 106, wherein it is automatically transported into abutment with a registration guide of an alignment means 110 and is fed farther therealong into the fold/seal mechanism of sheet folding and sealing apparatus 100. Cross carrier 106 comprises a plurality of driven rollers 112 that are angled with respect to the feed path, as shown, so that sheet 108 is moved toward alignment means 110 into abutment with the registration guide and subsequently into sliding contact therealong and simultaneous feed toward and into sheet folding and sealing apparatus 100.

Cross carriers of this kind have been customarily utilized for transporting materials and particularly sheets, for example to sheet folding systems from other equipment in situations requiring a substantially right-angle transport path and registration alignment of a thusly transported sheet.

Sheet folding and sealing apparatus 100 comprises a fold/seal mechanism for example C-fold/seal mechanism 10 (FIG. 1) or V-fold/seal mechanism 60 (FIG. 9) or the like. Device 102 is preferably a printer, such as, for example, the 'Electronic Printing System Xerox 9700' which is commercially available from the Xerox Corporation.

Mailable objects of the kind specifically shown in FIGS. 2 and 10, are provided with at least address information upon an appropriate outside face of the finished object in addition to any communication information folded within such object. Sheets that are preprinted upon both sides (for instance by duplex printing) are required to be fed to the apparatus, unless other provisions are made to apply address information to the object. Only one-sided preprinting may also be utilized, wherein address information is included in an appropriate location upon the sheet face that is folded within the mailable object, and wherein a window is provided in an appropriate position in the sheet fed to the apparatus so that the preprinted address is visible in the finished folded and sealed mailable object. The mailable objects 50 (FIG. 2) or 64 (FIG. 10), for example, may be provided with such a window in the lower face of the objects. Mailable object 64, of course, may alternately have such a window disposed in the upper face (flap) portion of the folded sheet.

Different kinds of folding and sealing may be performed depending on the disposition of the individual fold pans; the particular adjustments of the abutment stops; and, the adjustments of the adhesive applicator system in respect to the location of application of adhesive upon the sheet. As already shown by the specific example of the embodiment of the V-fold/seal mechanism 60 (FIG. 9), other practical embodiments can rely essentially on the same components, but produce different mailable objects.

For example, the arrangement shown in FIG. 1 may be appropriately adjusted to fold a sheet in half by the action of first fold pan 16, while adhesive is applied to the surface of the trailing half of the sheet, and the now half-folded and side-bonded sheet can be folded once more in half by the action of second fold pan 18, while adhesive spots are applied in the vicinity of the first fold edge. The resulting mailable object can then be sealed, as it exits from the mechanism, along its trailing edge by the adhesive spots, leaving the uppermost trailing sheet edge or flap edge unbonded, while this flap is held down along its side bonds. By slight readjustment of the adjustments, so that the sheet is not exactly folded in half by first fold pan 16 in a way that produces a slightly staggered spacing relationship between the two sheet edges, the adhesive spots applied in second fold pan 18 contact and bond both of these sheet ends when the second fold is performed. For instance, if the sheet edges are staggered by one quarter of an inch, adhesive spots that are applied in second fold pan 18 along a transverse line that is spaced one quarter of an inch from the first-folded edge bond both sheet ends to the first-fold end simultaneously.

A similar mailable object can be produced by utilizing (in addition to second fold pan 18) a fold pan that is identical to second fold pan 18 in place of the first fold pan 16 (FIG. 1), whereby adhesive spots are applied in both fold pans. A sheet that is thereby half-folded twice is thereby also appropriately bonded along its flap end. Similarly, the same result can be accomplished by feeding a sheet through the previously described system a second time.

It will be recognized that other variations in folding and sealing are practically achievable with the sheet folding and sealing mechanism of the present invention. For instance, half-folding a sheet and bonding only its ends by applying adhesive spots thereto only, without a need for perforating the resulting object provides mailable objects in a simple form that are customarily used at times, for example as a half-folded sheet that is stapled together.

As noted, certain prior art use of adhesive applicators avoided exertion of appreciable retarding forces onto handled sheets. In view of the foregoing description the disadvantages of such prior art devices will be now more readily recognized. The instant adhesive applicator system is superior to prior systems in many important aspects. Yet the present applicator nozzles, when advanced into contact with handled sheets, apply appreciable retarding forces thereto, a fact that has been recognized in the past as a decisive barrier to the use of such nozzles in folding-and-sealing systems.

The present invention, in respect to the adhesive applicator nozzles, is based on the novel recognition that, notwithstanding prior concerns, nozzles that apply appreciable retarding forces to handled sheets can nevertheless be used most advantageously. It is necessary, however, to provide for the adhesive applicator nozzles to apply adhesive at proper locations; and, that space is not always available in existing folding machines.

In FIG. 1, for example, adhesive may not be applied to sheet 46 in the sheet position shown, since nozzles 26 would have to be advanced to contact sheet 46. This would exert retarding forces on the sheet and tend to wrinkle and buckle the sheet before its leading edge is captured in the nip between rolls 40 and 41. Moreover, because the adhesive applicator system has to rely upon its actuation control that requires accurate input signals to establish position and motion of a handled sheet, the leading edge of sheet 46 must first be sensed by photosensor 36 before solenoids 28 may be energized to advance nozzles 26 onto sheet 46. However, once sheet 46 is captured by rolls 40 and 41 and transported further to have its leading edge sensed by photosensor 36, nozzles 26 may be advanced into contact with sheet 46 (adhesive being applied), as the sheet is now pulled from under nozzles 26 and cannot easily wrinkle or buckle. This means that adhesive cannot be applied starting immediately at the leading edge of sheet 46, but only at a particular distance therefrom. The actual layout of the mechanism in FIG. 1 permits starting application of adhesive when less than one third of sheet 46 has passed under nozzles 26, thusly facilitating the required correct adhesive application to sheets that may be already somewhat shorter than a standard sheet length of 11 inches.

Analogous reasoning applies if, for instance, other nozzle locations had been chosen. However, it will be understood that the regions between rolls and fold pans in the path of a handled sheet are not only rather cramped and cannot easily accomodate nozzles, but sheets are buckled in such regions and, therefore, not amenable to having nozzles exert forces upon their surfaces.

In general, the components of a folder, which are not necessarily included in FIG. 1, impose further critical limits, for instance on the closeness of nozzles to a first roll and on how close thereto an abutment stop of a fold pan may be adjusted. For example, in some conventional folding mechanisms it is not feasible to accommodate adhesive nozzles as shown in FIG. 1 close enough to the first roll and still obtain a one-third first fold length in a sheet of a minimum standard legth of 11 inches while adhesive is applied along the required two thirds of the trailing sheet length. This is one of the reasons why some prior art folding-and-sealing equipment relies upon offset-type adhesive application by transfer of adhesive via a fold roll.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. Apparatus for sheet folding and sealing to produce letter-like mailable objects from preprinted sheet material, said apparatus having a first side and an opposite side in relation to said first side, said apparatus comprising:

a feeder located on said first side for feeding individual sheets in seriatim from said first side, said apparatus accepting sheets through said first side;

at least one fold pan, all of said at least one fold pans being located on said opposite side, said at least one fold pan including an adjustable abutment stop;

fold/seal roll means for folding and sealing sheets in cooperation with said at least one fold pan, said fold/seal roll means comprising a main drive roll and a first, a second, and a third roll, said main drive roll and said first roll forming a first nip therebetween, said main drive roll and said second roll forming a second nip therebetween, said main drive roll and said third roll forming a third nip therebetween, wherein sheets, during folding and sealing thereof, are fed by said feeder into said first nip and thereafter are fed by said first, said second, and said third nips in that sequence therethrough, whereby folded and sealed sheets egress from said first side; and adhesive applicator means for application of adhesive to sheets in said apparatus for mutual bonding of folded sheet portions, wherein said adhesive applicator means include a plurality of bead applicator nozzles for applying adhesive beads along the direction of motion of sheets, said bead applicator nozzles being disposed upstream from said first nip, and wherein said adhesive applicator means further include a plurality of spot applicator nozzles for applying adhesive spots in locations along a transverse direction with respect to the motion of sheets, said spot applicator nozzles being disposed in proximity to said adjustable abutment stop in at least of said at least one fold pans; and, wherein at least one of said rolls includes a plurality of concentric cylindrical grooves disposed in axial locations exposed to contact with adhesive, a said grooves having a substantially cylindrical coating of PTFE material to prevent adhesion of adhesive thereto.

2. Apparatus of claim 1, wherein the outer surface of said substantially cylindrical coating has a smaller diameter than the diameters of adjacent surfaces of ungrooved portions of said rolls to further assist in avoidance of adhesion of adhesive to said coating.

3. Apparatus for sheet folding and sealing to produce letter-like mailable objects from preprinted sheet material, said apparatus having a first side and an opposite side in relation to said first side, said apparatus comprising:

a feeder located on said first side for feeding individual sheets in seriatim from said first side, said apparatus accepting sheets through said first side;

at least one fold pan, all of said at least one fold pans being located on said opposite side, said at least one fold pan including an adjustable abutment stop;

fold/seal roll means for folding and sealing sheets in cooperation with said at least one fold pan, said fold/seal roll means comprising a main drive roll and a first, a second, and a third roll, said main drive roll and said first roll forming a first nip therebetween, said main drive roll and said second roll forming a second nip therebetween, said main drive roll and said third roll forming a third nip therebetween, wherein sheets, during folding and sealing thereof, are fed by said feeder into said first nip and thereafter are fed by said first, said second, and said third nips in that sequence therethrough, whereby folded and sealed sheets egress from said first side; and adhesive applicator means for application of adhesive to sheets in said apparatus for mutual bonding of folded sheet portions, wherein said adhesive applicator means include a plurality of bead applicator nozzles for applying adhesive beads along the direction of motion of sheets, said bead applicator nozzles being disposed upstream from said first nip, and wherein said adhesive applicator means further include a plurality of spot applicator nozzles for applying adhesive spots in locations along a transverse direction with respect to the motion of sheets, said spot applicator nozzles being disposed in proximity to said adjustable abutment stop in at least of said at least one fold pans; and, wherein said at least one fold pan comprises components having surface regions exposed to contact with adhesive, said surface regions including PTFE material to avoid adhesion of adhesive thereto.

4. Apparatus for sheet folding and sealing to produce letter-like mailable objects from preprinted sheet material, comprising:

a feeder for feeding individual sheets in seriatim, said apparatus having a first side and an opposite side in respect to said first side and having a stacker disposed on said first side, said feeder being located on said first side of said apparatus;

at least one fold pan including an adjustable-abutment stop therein to effect buckling and folding of sheets fed into said at least one fold pan, wherein the adjustment of said adjustable abutment stop establishes the distance of a fold from the edge of sheets that abut said abutment stop, all of said at least one fold pans being located on said opposite side;

fold/seal roll means for folding and sealing sheets in cooperation with said at least one fold pan, said fold/seal roll means comprising a main drive roll and a first, a second, and a third roll, said main drive roll and said first roll forming a first nip therebetween, said main drive roll and said second roll forming a second nip therebetween, said main drive roll and said third roll forming a third nip therebetween, wherein sheets, during folding and sealing thereof, are fed by said feeder into said first nip and thereafter by said second and third nips in that sequence, whereby folded and sealed sheets egress from said first side to said stacker, said fold/seal roll means including means for preventing adhesion of adhesive material, said means for preventing including concentric grooves in surfaces of at least one of said first, second, third, and main drive rolls, said rolls having cylindrical outer diameters, said concentric grooves having cylindrical surfaces including non-adhesive material; and adhesive applicator means for the application of liquid adhesive to sheets being folded and sealed in said fold/seal roll means for mutual bonding of folded sheet portions;

said adhesive applicator means including a plurality of applicator nozzles for controlled application of liquid adhesive directly to sheets being folded and sealed, each of said applicator nozzles having a nozzle tip comprising metering means for metering adhesive, said metering means comprising an exit opening for dispensing adhesive and a spring-loaded ball disposed therein for blocking said exit opening, said spring-loaded ball being substantially freely rotatable, said adhesive applicator means further including engagement means for selectively advancing and retracting said applicator nozzles to and from, respectively, sheet surfaces, said spring-loaded ball contacting sheet surfaces and being displaced thereby against the spring-loading and thusly being operative in unblocking said exit opening and thereby having said metering means opened to apply adhesive thereby while said applicator nozzles are advanced toward sheet surfaces, said spring-loaded ball not contacting sheet surfaces and thereby having said metering means shut off adhesive flow while said applicator nozzles are retracted, said spring-loaded ball being substantially freely rotatable and being operative in rolling along sheet surfaces and thusly dispensing adhesive thereto while being in contact with sheet surfaces.

5. A method of sheet folding and sealing to produce letter-like mailable objects from preprinted sheet material, comprising the steps of:

feeding sheets in seriatim into fold/seal means from a feeder that is disposed on a first side of said fold/seal means;

transporting sheets through said fold/seal means;

delivering sheets from said fold/seal means to a stacker that is disposed on said first side, said fold/seal means being operative in folding and sealing of sheets and in transporting sheets therethrough, said fold/seal means including at least one fold pan having an adjustable abutment stop therein, said at least one fold pan being disposed on an opposite side with respect to said first side of said fold/seal means;

applying adhesive in continuous beads directly to portions of each sheet that are parallel to and proximate to lateral edges thereof by first applicator means while sheets are fed from said feeder into said fold/seal means, said step of applying adhesive including advancing said first applicator means into contact with each sheet to begin application of said adhesive, said step of applying adhesive further including retracting said first applicator means away from each sheet to stop application of said adhesive;

applying a plurality of spaced adhesive spots in said fold/seal means transversely onto each sheet by second applicator means, said step of applying a plurality of spots including momentarily advancing and retracting said second applicator means into and away from contact, respectively, with each sheet;

folding and sealing each sheet while each sheet is transported through said fold/seal means, said fold/seal means including a main roll and a first roll in nipping contact therewith thusly defining a first nip therebetween, a second roll in nipping contact with said main roll thusly defining a second nip therebetween, and a third roll in nipping contact with said main roll thusly defining a third nip therebetween, the axes of said first, third, and main rolls defining a first common plane, the axes of said second and main rolls defining a second common plane that is substantially orthogonally oriented with respect to said first common plane, said step of folding including nipping each sheet in said first, second, and third nips, in that order.

6. The method according to claim 5, including perforating each folded and sealed sheet parallel to and spaced from transverse edges thereof so that tearing at perforations removes sheet material including said continuous beads.

* * * * *